United States Patent [19]

Akst et al.

[11] 4,353,758

[45] Oct. 12, 1982

[54] DIRECT PROCESS FOR EXPLOSIVES

[76] Inventors: Irving B. Akst, 1032 Duncan St., Pampa, Tex. 79065; Mary M. Stinecipher, 324 Connie St., Los Alamos, N. Mex. 87544

[21] Appl. No.: 98,643

[22] Filed: Nov. 29, 1979

[51] Int. Cl.[3] ..... C06B 31/32

[52] U.S. Cl. ..... 149/109.6; 149/47; 149/92

[58] Field of Search ..... 149/47, 92, 109.6

[56] References Cited

U.S. PATENT DOCUMENTS

| | | | |
|---|---|---|---|
| 1,968,158 | 7/1934 | Naoum et al. | 149/47 |
| 2,165,470 | 7/1939 | Fisk | 167/65 |
| 2,168,562 | 8/1939 | Davis | 149/47 |
| 3,013,382 | 12/1961 | Doss | 60/35.4 |
| 3,082,593 | 3/1963 | Mahan | 60/35.4 |
| 3,431,155 | 3/1969 | Dunglinson et al. | 149/47 |
| 3,471,346 | 10/1969 | Lyerly | 149/47 |
| 4,110,136 | 8/1978 | Hershkowitz et al. | 149/47 |

FOREIGN PATENT DOCUMENTS

17734/76 3/1978 Australia .

OTHER PUBLICATIONS

Fujihira, Chem. Abs., 84, abs. #124,144d (1976).

Urbansk:, "Chemistry and Technology of Explosives", vol. II, pp. 470, 471, 475, Pergamon Press (1965) Oxford.

Morrison and Boyd, "Organic Chemistry", pp. 543-545, Allyn and Bacon, Inc. (1959) Boston.

*Primary Examiner*—Edward A. Miller

*Attorney, Agent, or Firm*—Wigman & Cohen

[57] ABSTRACT

A direct process of making ethylenediamine dinitrate through the reaction of ethylenediamine and ammonium nitrate.

3 Claims, No Drawings

DIRECT PROCESS FOR EXPLOSIVES

The Government has rights in this invention pursuant to Contract No. W-7405-ENG-36 awarded by the U.S. Department of Energy and Contract No. F08635-78-C-0215 awarded by the United States Air Force.

SUMMARY

This invention involves the production of ethylenediamine dinitrate from the non-explosive components ethylenediamine and ammonium nitrate. The conventional preparation of ethylenediamine dinitrate requires the use of nitric acid and is a very exothermic reaction which is difficult to control in large quantities. The process involved in this invention is slightly endothermic initially. Variations on the basic process include several. First, an excess of ammonium nitrate may be used with the starting materials to form the eutectic of ammonium nitrate and ethylenediamine dinitrate which is an even better explosive than ethylenediamine dinitrate. Other additives which can be used include nitrophenols, nitroheterocycles, and picric acid for formation of a solid with the byproduct ammonia. Heating or allowing the ammonia to escape by other means enables the product to form a solid more rapidly from the slurry stage that initially results. Other explosives may be added to the materials to sensitize the reaction. The product of the basic reaction remains a slurry for several days unless some means of removing the ammonia is utilized and this slurry may be poured as desired prior to formation of the solid.

DETAILED DESCRIPTION INCLUDING A DESCRIPTION OF THE PREFERRED EMBODIMENT

The reaction of ethylenediamine and ammonium nitrate is a quantitative acid-base reaction to form a salt, ethylenediamine dinitrate, and a weak base, ammonia, according to the following chemical equation:

$$2\ NH_4NO_3 + C_2H_8N_2 \longrightarrow C_2H_{10}N_4O_6 + 2\ NH_3$$

ammonium nitrate — ethylenediamine — ethylenediamine dinitrate — ammonia

The basic reaction proceeds fairly rapidly but the product and byproduct may remain in a slurry state for several days prior to solidification. The product is explosive in the slurry state and may be used as is or poured into place for use as an explosive. The solidification of the product ethylenediamine dinitrate can be hastened by the removal of the byproduct ammonia. This can be accomplished by heating or otherwise removing the ammonia or by reacting the ammonia with an additional substance to form a solid.

The amounts of ammonium nitrate and ethylenediamine used in the initial process determine the final stoichiometry of the mixture. To prepare the eutectic mixture, which is a 50/50 weight ratio of ethylenediamine dinitrate to ammonium nitrate or a mole ratio of 2.33/1, one mole of ethylenediamine is added to 4.33 moles ammonium nitrate. Two moles of ammonia are formed. Much of the ammonia is evolved during addition and the rest is evolved on standing as the product solidifies. This mixture or others of different stoichiometry can be used as formed as a blasting explosive.

To prepare an explosive of greater power, the eutectic mixture is heated to 110° C. (8° greater than the eutectic melting point). After the melt is uniform, it can be cooled quickly for use as a pressing powder or cast. Additives to the melt to get desired explosive and physical properties may be RDX (1,3,5-trinitro-1,3,5-triazacyclohexane), HMX (1,3,5,7-tetranitro-1,3,5,7-tetraazacyclooctane, PETN (pentaerythritol tetranitrate), TNT (2,4,6-trinitrotoluene), NQ (nitroguanidine), TATB (1,3,5-triamino-2,4,6-trinitrobenzene), nitroheterocycles, and aluminum.

Another approach to utilizing the ammonia given off during the reaction is to add a material which neutralizes the ammonia and forms an ammonium salt. It may be an explosive (for example, picric acid) or a non-explosive material which does not degrade the explosive performance too much (for examples, a nitrophenol or a nitrated biphenol, both of which pick up ammonia at ambient temperature).

We claim:

1. A method of forming an explosive mixture of ammonium nitrate and ethylenediamine dinitrate which comprises:
   (a) combining ethylenediamine and a stoichiometric excess of ammonium nitrate, said ammonium nitrate being present in an amount to form, after reaction of said ethylenediamine therewith, a mixture of ammonium nitrate and ethylenediamine dinitrate; and
   (b) reacting said ethylenediamine with the stoichiometric portion of said ammonium dinitrate to form said explosive mixture of ammonium nitrate and ethylenediamine dinitrate.

2. The method of claim 1 wherein the mixture of step (b) is heated to form a uniform melt and thereafter cooled to solidify said uniform melt.

3. The method of claims 1 or 2 wherein said explosive mixture of step (b) is an eutectic mixture.

* * * * *

UNITED STATES PATENT AND TRADEMARK OFFICE

CERTIFICATE OF CORRECTION

PATENT NO. : 4,353,758

DATED : October 12, 1982

INVENTOR(S) : Irving B. Akst; Mary M. Stinecipher

It is certified that error appears in the above—identified patent and that said Letters Patent is hereby corrected as shown below:

Claim 1, line 11, "dinitrate" should read --nitrate--.

Signed and Sealed this

*Twenty-first* Day of *December 1982*

[SEAL]

*Attest:*

GERALD J. MOSSINGHOFF

*Attesting Officer*

*Commissioner of Patents and Trademarks*